United States Patent [19]

Kobayashi

[11] Patent Number: 4,845,797

[45] Date of Patent: Jul. 11, 1989

[54] FLOOR CLEANER

[75] Inventor: Kiyoshi Kobayashi, Chiba, Japan

[73] Assignee: Kabushiki Kaisha Hoky, Chiba, Japan

[21] Appl. No.: 109,616

[22] Filed: Oct. 19, 1987

[30] Foreign Application Priority Data

Oct. 20, 1986 [JP] Japan ..... 61-160769[U]
Oct. 20, 1986 [JP] Japan ..... 61-160770[U]

[51] Int. Cl.[4] ..... A47L 11/33

[52] U.S. Cl. ..... 15/41 R; 15/43; 15/179; 15/230.16

[58] Field of Search ..... 15/41–46, 15/48

[56] References Cited

U.S. PATENT DOCUMENTS 4,007,508 2/1977 Ooyachi ..... 15/42
4,325,156 4/1982 Rosendall ..... 15/41 R
4,646,380 3/1987 Kobayashi et al. ..... 15/41 R

FOREIGN PATENT DOCUMENTS 1377905 9/1964 France ..... 15/41 R
2135869 9/1984 United Kingdom ..... 15/41 R
8404663 12/1984 World Int. Prop. O. ..... 15/41 R

*Primary Examiner*—Edward L. Roberts
*Attorney, Agent, or Firm*—Wenderoth, Lind & Ponack

[57] ABSTRACT

A floor cleaner has driven rollers integrally mounted with a pair of rotating cleaning bodies on respective opposite end portions thereof, each of the rotating cleaning body being provided with a plurality of blades made of an elastic material, and wheels including a pair each of main wheels disposed at forward and rear portions of the casing and auxiliary wheels each of which is located at an intermediate position defined between the respective rotating bodies and main wheels. Each of the auxiliary wheels is positioned somewhat lower than the respective main wheels, i.e. they are collectively arranged in a seesaw-like condition. The main wheels and the auxiliary wheels are journaled to the casing in such a manner that both are swingable toward the front and the rear of the casing. Idle rollers are journaled to the casing between the respective main wheels and the respective driven rollers in a swingable manner. The auxiliary wheels are adapted to freely abut and to be movable away from both the forward and rear driven rollers, respectively, and the respective idle rollers are adapted to freely abut and to be movable away from both the forward or the rear main wheels and the forward or the rear driven rollers, respectively.

3 Claims, 4 Drawing Sheets

FLOOR CLEANER

FIELD OF THE INVENTION

The present invention relates to a floor cleaner having a pair of rotating cleaning bodies for sweeping away particles of dust, and particularly to a floor cleaner being capable of introducing particles of dust ranging from tiny ones to comparatively large-sized ones on a floor thereinto with efficiency.

DESCRIPTION OF THE RELATED ART

Heretofore, a floor cleaner which sweeps away dust or rubbish on a floor by means of a rotating brush disposed in the cleaner as shown in FIG. 4 has been proposed.

More specifically, the floor cleaner shown in FIG. 4 is constructed such that dust boxes 102and 102*c* are disposed in the front and the rear of a casing 100, respectively, and a rotating brush, a so-called bristle brush 103 prepared by embedding a plurality of bristles in the outer circumference of a roll, is disposed between these dust boxes 102and 102*c*. The rotating brush 103 is rotated interlockingly with wheels 104 through a gear mechanism. Intakes for dust 102*a* and 102*d* of the respective dust boxes 102and 102*c* are face the outer circumference of the rotating brush 103. Furthermore, since such a conventional floor cleaner as described above is provided with a gear mechanism, a countermeasure for preventing dust has been applied thereto. In a practical use of the conventional floor cleaner, when the bristle on the rotating brush 103 contacts particles of dust on a floor, either such particles are swept up from the floor to be introduced into the forward dust box 102or into the rearward dust box 102*c* as a result of rebounding from the top or the like of the casing 100 by means of the rotation of said rotating brush 103.

While the above-described floor cleaner can catch most of the dust particles on the floor and hold such particles in the dust boxes 102and 102*c* as a result of the rotation of the rotating brush 103 during movement of the cleaner on the floor, some of such dust particles are flung out forwardly through a gap defined between the surface of the floor and the underside of the casing 100. Such a tendency is not much of a problem when a carpet has been spread on the floor to be cleaned, but if the floor is made of plastic tile, marble, wood and the like without using any carpet or the like, the surface of such a floor is flat and as a result, dust, particularly in the form of solid particles, slides on the floor and is flung far and forwardly when the floor is swept. In order to eliminate such a disadvantage, a floor cleaner as shown in FIG. 5 has been proposed heretofore and has been put to practical use.

More specifically, the floor cleaner shown in FIG. 5 is constructed such that dust boxes 102and 102*c* are disposed in the front and in the rear of a casing 100 as in the devices of FIG. 4, and a pair of bristle type rotating brushes 103*a* and 103are disposed between said dust boxes 102and 102*c* in parallel to each other. These members are arranged such that the respective rotating brushes 103*a* and 103cooperate with each other so as to be rotated in opposite directions to one another by means of a gear mechanism comprising wheels 104. Furthermore, dust intakes 102*a* and 102*d* of the respective front and rear dust boxes 102and 102*c* are face the outer circumferences of said rotating brushes 103*a* and 103*b*, respectively. During practical use, when the forward rotating brush 103*a* contacts particles of dust on a floor, such particles are introduced into the dust box 102or 102*c* by means of a synergistic spring action derived from rotation of both the forward and rearward rotating brushes 103*a* and 103*b*.

In the conventional floor cleaner shown in FIG. 5, however, dust particles which were swept away in the forward direction by means of the rearward rotating brush 103*b* are intercepted by the forward rotating brush 103a. Thus, although this type of floor cleaner can sweep up dust particles more efficiently than the floor cleaner shown in FIG. 4, there is a disadvantage in that dust particles passed through gaps each defined between bristles on the forward rotating brushes 103*a* are also flung out in the forward direction of the cleaner. This is because each brush surface of the rotating brushes 103*a* and 103has a roll furnished with a plurality of bristles. Furthermore, it is known that if a distance h extending from the surface of a floor to the underside of the casing 100 is reduced, the amount of dust particles flung out without being introduced into the dust box(es) decreases. In this case, however, if there are somewhat larger dust particles on the floor, the underside of the casing 100 cannot pass over such particles resulting in a disadvantage of insufficient cleaning.

Moreover, another floor cleaner as shown in FIG. 6 is proposed at the present time and which is constructed such that a guiding member 100*a* extending downwards from the top of a casing 100 is interposed between a forward rotating brush 103*a* and a rearward rotating brush 103and said guiding member 100*a* is positioned in a sufficiently close relation with the surface of a floor, whereby dust particles are prevented from being flung out by means of the rotating brushes 103*a* and 103*b*. A sufficient distance from the surface of the floor to the underside of the casing 100 is maintained. However, even in the floor cleaner as shown in FIG. 6, the such disadvantage associated with the conventional floor cleaner shown in FIG. 5 remains present because the forward rotating brush is a bristle brush. In addition, there is no synergistic sweeping action of the rotating brushes 103*a* and 103*b*, so that there is another disadvantage in that particles of dust are retained by means of each gap defined between either the rotating brush 103*a* or the rotating brush 103and the guiding material 100*a* , and such dust particles cover the lower end of the guiding member 100*a*.

OBJECT AND SUMMARY OF THE INVENTION

The present invention has been made in view of the disadvantages discussed above, and an object thereof is to provide a cleaner capable of sweeping particles of dust ranging from tiny ones to comparatively large-sized ones off a floor with high efficiency and without any appreciable dust particles remaining on the floor.

The object of the present invention is attained by providing a floor cleaner wherein a pair of rotating cleaning bodies are journaled to the central portion of a casing having dust boxes at a forward and a rear portion thereof in a rotatable manner, dust intakes of the respective forward and rear dust boxes to face the respective rotating cleaning bodies, and the outer circumference of each of said respective forward and rear rotating cleaning bodies is provided with a plurality of blades made of an elastic material.

BRIEF DESCRIPTION OF THE DRAWINGS

FIGS. 1–3 are views each illustrating an embodiment of the floor cleaner according to the present invention wherein FIG. 1 is a partially broken away sectional view taken along the line I—I of FIG. 2;

FIG. 2 is a bottom view of the floor cleaner and

FIG. 3 is a side view showing the floor cleaner of FIG. 1 in which a part of the side wall of a casing is broken away.

DETAILED DESCRIPTION OF THE PREFERRED EMBODIMENT

Figure 1:
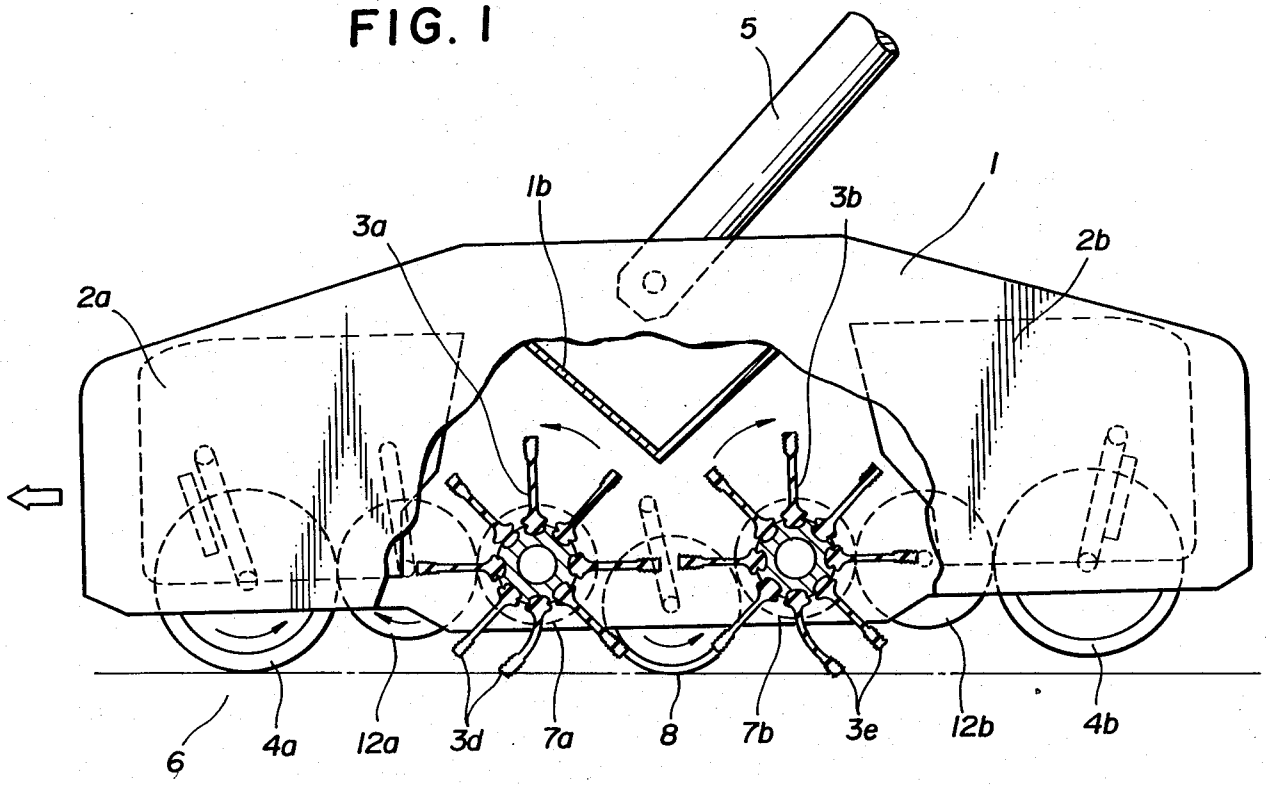

An embodiment of the floor cleaner according to the present invention will be described hereinbelow in detail by referring to FIGS. 1–3 wherein a casing 1 contains a mechanism for sweeping up particles of dust and onto the top of which a distal end portion of a handle 5 to be gripped by a user is rotatably journaled. Dust boxes 2*a* and 2are disposed on the opposite sides of the casing 1 in front and rear portions thereof (the right and left sides of the casing in FIGS. 1 and 3, or the upper and lower sides of the casing in FIG. 2, respectively). A cover (not shown) is removably fitted to the casing 1 which is positioned over the dust boxes 2*a* and 2*b*.

A pair of rotating cleaning bodies 3*a* and 3are mounted respective locations adjacent the dust boxes 2*a* and 2of the casing 1 and extend in widthwise direction thereof. These rotating cleaning bodies 3*a* and 3are spaced apart a prescribed distance and extend parallel to each other, and opposite end portions of each of the cleaning bodies 3*a* and 3*b* are rotatably journaled to side walls of the casing 1, respectively. Furthermore, each of the rotating cleaning bodies 3*a* and 3is in the form of a so-called blade brush which is constructed such that onto the outer circumference of a roll extending in the widthwise direction of the casing 1, each end of plural blades 3*d*, 3*d*, . . . and 3*e*, 3*e*, . . . is spirally fixed (or the blades may be straight), said blades made from a flexible elastic material such as a rubber or comprising a synthetic resin sheet or plate, a metallic spring plate and the like. The surface of each said blade is further provided with innumerable projections, and a pair of these blades of each rotating cleaning body extend rectilinearly along the opposite sides thereof and all the blades diverge from the center of the roll. Each of both the blades 3*d* and 3*e* has a length somewhat longer than a prescribed length at which each of said blades would just contact the surface of a floor 6. Moreover, driven rollers 7*a*, 7*a* and 7*b*, 7are axially mounted to opposite ends of both the rotating cleaning bodies 3*a* and 3in an integral manner therewith, respectively, so that these driven rollers 7*a*, 7*a* and 7*b*, 7are synchronously rotated with said rotating cleaning bodies 3*a* and 3*b*.

At an intermediate position defined between each set of the driven rollers 7*a* and 7*b*, an auxiliary wheel 8 is mounted between these driven rollers. The auxiliary wheel 8 is suspended from a bracket 10*a* secured to the inner surface of the casing 1 through a swing arm 9*a* which is prepared by shaping a round bar into a substantially ɔ-shape and has a mechanism one end of which is fitted in the bracket (swingably) and the other end of which supports the auxiliary wheel (rotably). The auxiliary wheel 8 is adapted to abut and engage with the driven roller 7*a* or 7facilitated by the swinging of the swing arm 9*a*. The lowermost surface of the auxiliary wheel 8 is located at a position lower than that of the underside of the casing 1, so that the auxiliary wheel 8 is adapted to always contact the surface of the floor 6.

Furthermore, the underside of the casing 1 is provided with two pairs of main wheels 4*a*, 4*a* and 4*b*, 4at the opposite front and rear portions thereof. Each of these main wheels 4*a*, 4*a*, 4*b*, and 4is suspended from another bracket 10secured to the inside of the casing 1 through a swing arm 9*b* similar to said auxiliary wheel 8. A stopper 11 associated with each swing arm 9extends downwardly from each bracket 10and hence, the swing arm 9abuts the stopper 11 so that the rotation thereof is restricted. As in the auxiliary wheel 8, the lowermost surface of each of the main wheels 4*a*, 4*a*, 4*b*, and 4*b* is located at a position lower than that of the underside of the casing 1, so that each main wheel is adapted to contact the surface of the floor 6. Comparing the lowermost surfaces of both the auxiliary wheel 8 and the main wheels 4*a*, 4*a* or 4*b*, 4*b*, the auxiliary wheel 8 is slightly lower than that of each of the main wheels 4*a*, 4*a* or 4*b*, 4*b*. In other words, these wheels collectively provide seesaw-like situation.

Each set of both idle rollers 12*a*, 12*a* and 12*b*, 12is interposed between the driven roller 7*a* and the main wheel 4*a* and the driven roller 7and the main wheel 4*b*, respectively, at each intermediate position defined between the driven roller 7*a* and the main wheel 4*a* or the driven roller 7*b* and the main wheel 4*b*. Each of the idle rollers 12*a*, 12*a* and 12*b*, 12is swingably suspended from a bracket 10*c* secured to the inside of the casing 1 through a swing arm 9*c* as are said auxiliary wheel 8, and the main wheels 4*a* and 4*b*, so that the idle roller 12*a* is adapted to freely abut and to be movable away from the driven the driven roller 7*a* and the main roller 4*a*, respectively, and similarly the idle roller 12is adapted to freely abut and to be movable away from the driven roller 7and the main roller 4*b*, respectively.

A guiding member 1is provided on the ceiling of the casing 1, a section thereof has a substantial V-shape and is disposed at an intermediate position defined between the rotating cleaning bodies 3*a* and 3*b*. Extending portions of the guiding member 1*b* extend to and are contiguous with dust intakes 2*c* and 2*d* of the dust boxes 2*a* and 2*b*, respectively.

Figure 2:
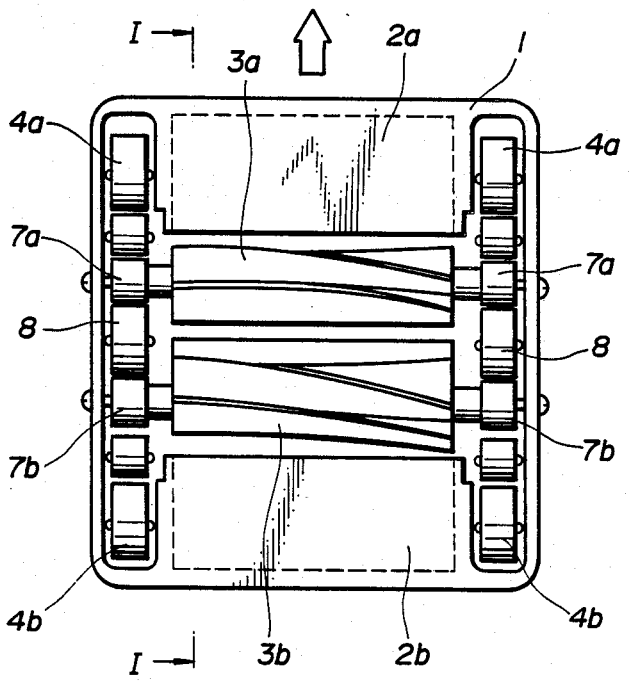
Figure 3:
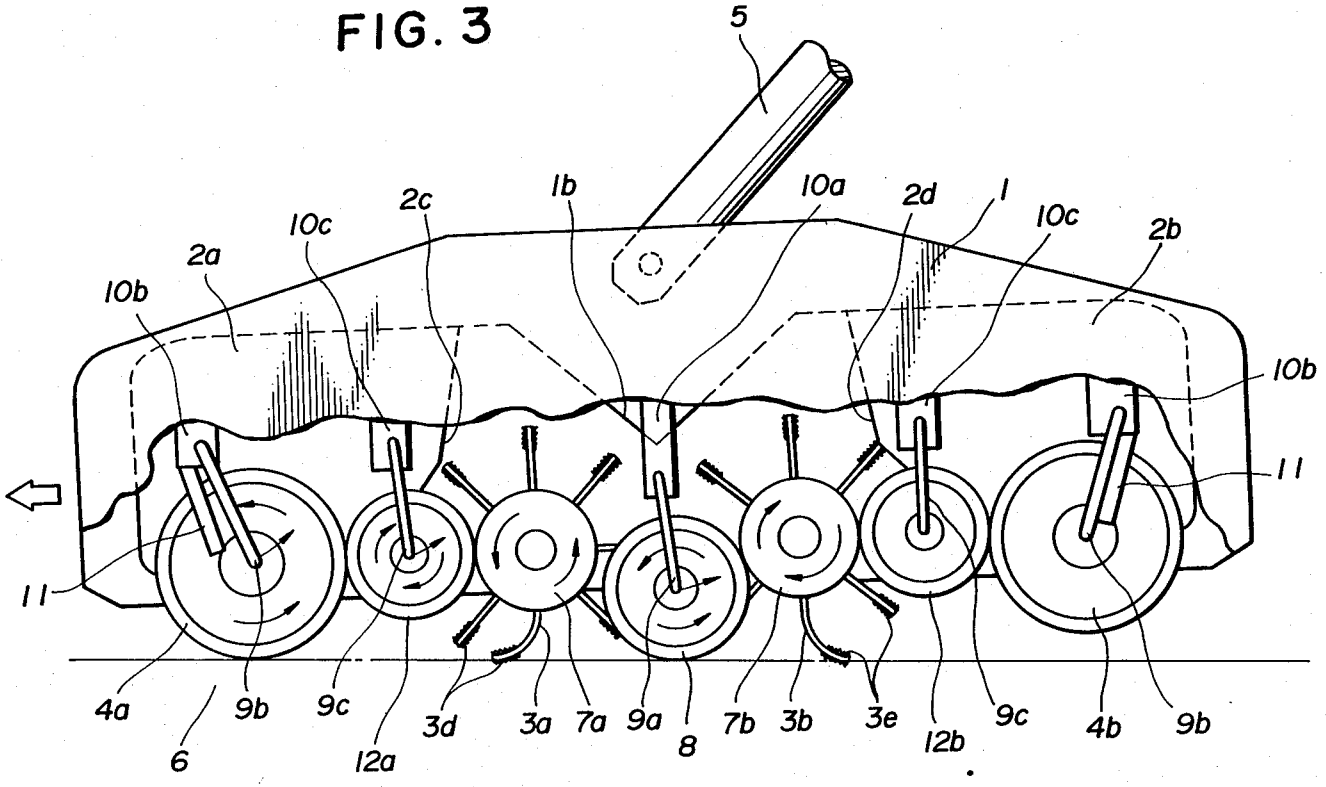
Figure 4:
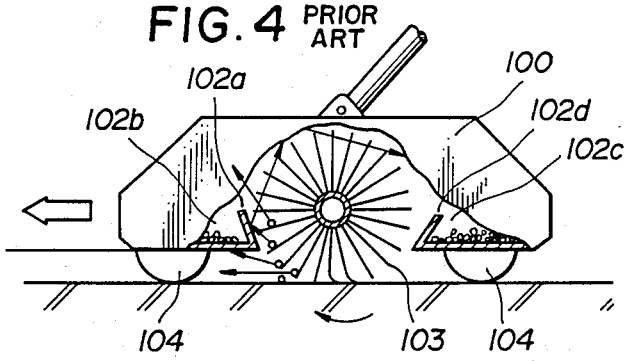
FIG. 4 PRIOR ART
FIGS. 4–6 are partially broken away side views showing conventional floor cleaners, respectively.
Figure 5:
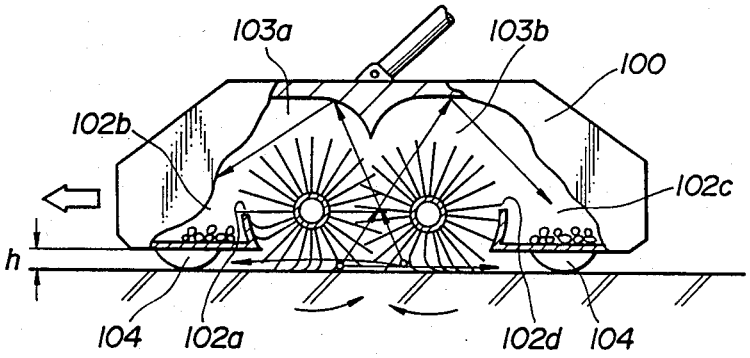
FIG. 5 PRIOR ART
Figure 6:
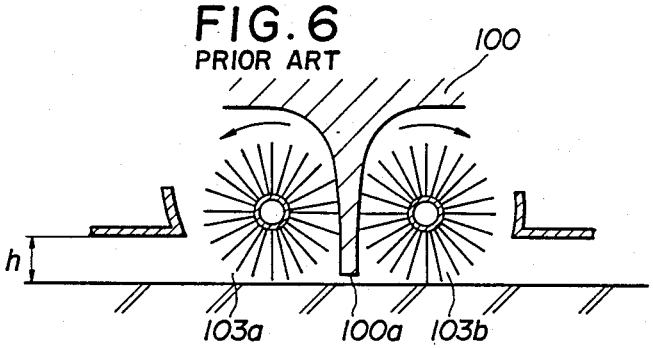
FIG. 6 PRIOR ART

When it is intended to sweep dust particles off of the floor 6 by the use of the floor cleaner according to the present invention, the floor cleaner main body is first placed on the floor 6 at a desired position, and the cleaner is then pushed along the direction indicated by arrows in FIGS. 1–3 by a user who grips the handle 5 of the cleaner. As a result, the forward main wheels 4*a*, 4*a* and the auxiliary wheels 8, 8 abut against the floor 6, and the floor cleaner is allowed to proceed forwardly so that the main wheels 4*a*, 4*a* swing rearwardly through the swing arms 9*b*, 9to commence rotation in the direction of the arrows in FIGS. 1–3, and at the same time the main wheels 4*a*, 4*a* abut against the idle rollers 12*a*, 12*a* to swing them rearwards through the swing arms 9*c*, 9*c*, whereby the idle rollers 12*a*, 12*a* are abut against the driven rollers 7*a*, 7*a*. In this case, the rotation of the main wheels 4*a*, 4*a* is transmitted to the idle rollers 12*a*, 12*a* as rotation in the direction of the arrows in FIGS. 1 and 3, and further such rotation is transmitted to the driven rollers 7*a*, 7*a* as well as the rotating cleaning body 3*a* being integral with said driven rollers 7*a*, 7*a* as notation in the direction of the arrows in FIGS. 1 and 3, i.e. the rotation taken from the floor 6 is transmitted to the rotating cleaning body 3*b*. Moreover, in this case, the auxiliary wheels 8, 8 are swung rearwards at the same time through the swing arms 9*a*, 9*a* to abut against the driven rollers 7*b*, 7*b*, whereby the rotation of the auxiliary wheels 8,8 is transmitted to the driven rollers 7*b*, 7as well as the rotating cleaning body 3being integral with said driven rollers 7*b*, 7as notation in the direction of the arrows in FIGS. 1 and 3, i.e. the rotation taken from the floor 6 is also transmitted to the rotating cleaning body 3*a*.

Accordingly, when the floor cleaner main body advances generating the motion of the main wheels 4*a*, 4*a* as well as the motion of the auxiliary wheels 8, 8, the rotating cleaning bodies 3*a* and 3*b* rotate in opposite directions, respectively. In this case, since the main wheels 4*b*, 4are positioned somewhat higher than the auxiliary wheels 8, 8, the main wheels 4*b*, 4are away from the floor 6 in a free condition so that they do not rotate. Further, the idle rollers 12*b*, 12are not urged against any member and they are maintained in a neutral condition. Thus, when the rotating cleaning bodies 3*a* and 3continue to rotate and the blades 3*d*, 3*d*, . . . as well as 3*e*, 3*e*, . . . of the rotating cleaning bodies 3*a* and 3contact particles of dust on the floor 6, such particles are flung out towards either the rear side of the rotating cleaning body 3*a* or the forward side of the rotating cleaning body 3by means of a spring-up action derived from elasticity of the blades 3*d*, 3*d*, . . . and 3*e*, 3*e*, . . ., so that these dust particles are introduced into the dust boxes 2*a* and 2through the dust intakes 2*c* and 2d. While a case exists in which the dust particles swept away by means of the blades 3*d*, 3*d*, . . . as well as 3*e*, 3*e*, . . . are directly introduced into the dust boxes 2*a* and 2*b*, in most of cases, such dust particles are introduced into and collected in the dust boxes 2*a* and 2after they rebound from the guiding member 1positioned at the ceiling of the casing 1.

Although dust particles are not necessarily swept upwardly after they contact the blades 3*e*, 3*e*, . . ., but can be flung out forwardly, even in this case, the particles flung out are positively intercepted by the blades 3*d*, 3*d*, . . . of the forward rotating cleaning body 3*a*, and at the same time these dust particles are introduced into the dust box 2*a* or 2by means of sweeping-off actions derived from the blades 3*d*, 3*d*, . . . as well as 3*e*, 3*e*, . . .. Moreover, large-sized particles of dust are raised upwardly by means of a synergistic action of the rotating cleaning bodies 3*a* and 3*b*, so that such dust particles are introduced into the dust box 2*a* or 2*b*.

When the floor cleaner main body is retreated when a user pulls the handle 5, the casing 1 tilts slightly towards the rear with the auxiliary wheels 8, 8 which are in contact with the floor 6 as centers of the casing, so that the rearward main wheels 4*b*, 4come into contact with the floor 6 instead of the forward main wheels 4*a*, 4*a*. As a result, the main wheels 4*b*, 4swing forwardly through the swing arms 9*b*, 9to abut against the idle rollers 12*b*, 12*b*, thereby causing the idle rollers 12to swing forward, 12through the swing arms 9*c*, 9*c*, and thus, the main wheels 4*b*, 4*b*, the idle rollers 12*b*, 12*b*, and the driven rollers 7*b*, 7*b* successively abut. In this case, the auxiliary wheels 8, 8 swing simultaneously towards the forward direction through the swing arms 9*a*, 9*a* to abut against the driven rollers 7*a*, 7*a*, while the further forward idle rollers 12*a*, 12*a* and main rollers 4*a*, 4*a* are maintained in neutral conditions in which they are not urged against any of the other members.

Then, when the rotation of the main wheels 4*b*, 4and that of the auxiliary wheels 8, 8 are transmitted to the rearward driven rollers 7*b*, 7and the forward driven rollers 7*a*, 7*a*, respectively, as described above, the rotating cleaning bodies 3*a* and 3rotate in opposite directions, respectively, so that particles of dust on the floor 6 are swept away in the same manner as described above.

As described above, the floor cleaner according to the present invention is constructed such that a pair of rotating cleaning bodies are rotatably journaled to the central portion of a casing provided with dust boxes at the forward and rearward portions thereof, dust intakes of said forward and rearward dust boxes face said rotating cleaning bodies, respectively, and a plurality of blades made of an elastic material are embedded in the outer circumference of each of said rotating cleaning bodies. Thus, according to the floor cleaner of the present invention, the rotating cleaning body located at a rear position of the cleaner flings particles of dust from a floor in forward as well as forward and upward directions, and these dust particles are intercepted almost completely by means of the blades of the rotating cleaning body located at a forward position of the cleaner. Simultaneously, the forward rotating cleaning body flings dust particles in an upwardly rear direction, so that such dust particles can be flung along a prescribed course by the cooperation of a pair of said rotating cleaning bodies, whereby the efficiency of sweeping off particles of dust is elevated. Furthermore, a distance extending from the surface of a floor to the underside of the casing can be sufficiently maintained, and a synergistic sweeping away action of dust particles derived from a pair of the rotating cleaning bodies is effected in the floor cleaner according to the present invention, and accordingly, the cleaner can positively sweep off particles of dust ranging from tiny ones to large-sized ones.

Moreover, in the cleaner of the invention, a pair of rotating brushes can always rotate in opposite directions, respectively, irrespective of a forward or rearward movement thereof with a comparatively simple construction without employing any gear mechanism, and hence, the floor cleaner of this invention can sufficiently function even on a somewhat irregular surface. The manufacturing cost of the cleaner is less than that of conventional floor cleaners, maintenance of the cleaner of this invention is easy so that it is more advantageous than conventional ones, and in addition, no countermeasure for preventing dust is required in the cleaner according to the present invention.

I claim:

1. A floor clean comprising:

a casing including a front portion, a central portion, a rear portion, and a respective dust box disposed at said front and at said rear portion, each said respective dust box including an opening;

a pair of cleaning bodies rotatably mounted to said casing at the central portion thereof, each of said cleaning bodies including a central roll and a plurality of blades comprising elastic material extending from said central roll, each said opening of the dust boxes facing a respective one of said cleaning bodies;

driven rollers integral with each of said cleaning bodies and disposed, respectively, at opposite ends thereof;

a pair of rotatable front main wheels swingably mounted to said casing, disposed at said front portion thereof and swingable toward and away from the rear portion of said casing, and a pair of rotatable rear main wheels swingably mounted to said casing, disposed at said rear portion thereof and swingable toward and away from the front portion of said casing;

rotatable auxiliary wheels swingably mounted to said casing, disposed respectively between one said driven roller integral with one of said cleaning bodies and another said driven roller integral with the other of said driven bodies, and swingable toward the front and rear portions of said casing between a first position in contact with said one driven roller while being out of contact wit said another driven roller and a second position contacting said another driven roller while being out of contact with said one driven roller;

the outer circumference of said auxiliary wheels extending beyond a plane that extends outside of said casing and tangentially to the outer circumference of said front and said rear main wheels; and rotatable idle wheels swingably mounted to said casing, respective ones of said idle wheels disposed between said front main wheels and said one of said cleaning bodies, and between said rear main wheels and said other of said cleaning bodies, said idle wheels disposed between said front main wheels and said one of said cleaning bodies abutting said front main wheels and said one of said cleaning bodies when said front main wheels are swung toward the rear portion of said casing as the cleaner is moved in a forward direction, and said idle wheels disposed between said rear main wheels and said another of said cleaning bodies abutting said rear main wheels and said another of said cleaning bodies when said rear main wheels are swung forwardly when the cleaner is moved in a rearward direction opposite said forward direction.

2. A floor cleaner comprising:

a casing including a front portion, a central portion, a rear portion, and a respective dust box disposed at said front and at said rear portion, each said respective dust box including an opening;

a pair of cleaning bodies rotatably mounted to said casing at the central portion thereof, each of said cleaning bodies including a central roll and a plurality of blades comprising elastic material extending from said central roll, each said opening of the dust boxes facing a respective one of said cleaning bodies;

driven rollers integral with each of said cleaning bodies and disposed, respectively, at opposite ends thereof;

a pair of rotatable front main wheels swingably mounted to said casing, disposed at said front portion thereof and swingable toward and away from the rear portion of said casing, and a pair of rotatable rear main wheels swingably mounted to said casing, disposed at said rear portion thereof and swingable toward and away from the front portion of said casing;

rotatable auxiliary wheels swingably mounted to said casing, disposed respectively between one said driven roller integral with one of said cleaning bodies and another said driven roller integral with the other of said driven bodies, and swingable toward the front and rear portions of said casing between a first position in contact with said one driven roller while being out of contact with said another driven roller and a second position contacting said another driven roller while being out of contact with said one driven roller;

the outer circumference of said auxiliary wheels extending beyond a plane that extends outside of said casing and tangentially to the outer circumference of said front and said rear main wheels, and rotatable idle wheels mounted to said casing, respective ones of said idle wheels disposed between said front main wheels and said one of said cleaning bodies, and between said rear main wheels and said other of said cleaning bodies, said idle wheels disposed between said front main wheels and said one of said cleaning bodies abutting said front main wheels and said one of said cleaning bodies when said front main wheels are swung toward the rear portion of said casing as the cleaner is moved in a forward direction, and said idle wheels disposed between said rear main wheels and said another of said cleaning bodies abutting said rear main wheels and said another of said cleaning bodies when said rear main wheels are swung forwardly when the cleaner is moved in a rearward direction opposite said forward direction.

3. A floor cleaner comprising:

a casing including a front portion, a central portion, a rear portion, and a respective dust box disposed at said front and at said rear portion, each said respective dust box including an opening;

a pair of cleaning bodies rotatably mounted to said casing at the central portion thereof, each of said cleaning bodies including a central roll and a plurality of blades comprising elastic material extending from said central roll, each said opening of the dust boxes facing a respective one of said cleaning bodies;

driven rollers integral with each of said cleaning bodies and disposed, respectively, at opposite ends thereof;

a pair of rotatable front main wheels swingably mounted to said casing, disposed at said front protion thereof and swingable toward and away from the rear portion of said casing, and a pair of rotatable rear main wheels swingably mounted to said casing, disposed at said front portion thereof and swingable toward and away from the front portion of said casing;

rotatable auxiliary wheels swingably mounted to said casing, disposed respectively between one said driven roller integral with one of said cleaning bodies and another said driven roller integral with the other of said driven bodies, and swingable toward the front and rear portions of said casing between a first position in contact with said one driven roller while being out of contact with said another driven roller and a second position contacting said another driven roller while being out of contact with said one driven roller; and rotatable idle wheels swingably mounted to said casing, respective ones of said idle wheels disposed between said front main wheels and said one of said cleaning bodies, and between said rear main wheels and said other of said cleaning bodies, said idle wheels disposed between said front main wheels and said one of said cleaning bodies abutting said front main wheels and said one of said cleaning bodies when said front main wheels are swung toward the rear portion of said casing as the cleaner is moved in a forward direction, and said idle wheels disposed between said rear main wheels and said another of said cleaning bodies abutting said rear main wheels and said another of said cleaning bodies when said rear main wheels are swung forwardly when the cleaner is moved in a rearward direction opposite said forward direction.

* * * * *